US009108412B2

(12) United States Patent
Chino

(10) Patent No.: US 9,108,412 B2
(45) Date of Patent: Aug. 18, 2015

(54) CLEANING MEMBER AND LIQUID EJECTING APPARATUS

(71) Applicant: SEIKO EPSON CORPORATION, Tokyo (JP)

(72) Inventor: Toru Chino, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 82 days.

(21) Appl. No.: 13/787,367

(22) Filed: Mar. 6, 2013

(65) Prior Publication Data

US 2014/0002542 A1 Jan. 2, 2014

(30) Foreign Application Priority Data

Jun. 28, 2012 (JP) ..... 2012-145563
Nov. 22, 2012 (JP) ..... 2012-256414

(51) Int. Cl.
*B41J 2/165* (2006.01)

(52) U.S. Cl.
CPC ..... *B41J 2/16535* (2013.01)

(58) Field of Classification Search
USPC ..... 347/22–39
See application file for complete search history.

(56) References Cited

U.S. PATENT DOCUMENTS

| | | | | |
|---|---|---|---|---|
| 4,933,015 | A * | 6/1990 | White | 134/6 |
| 5,589,865 | A * | 12/1996 | Beeson | 347/28 |
| 6,491,370 | B2 * | 12/2002 | Momose | 347/30 |
| 6,550,890 | B2 * | 4/2003 | Saijo | 347/29 |
| 7,252,363 | B2 * | 8/2007 | Takagi et al. | 347/29 |
| 2004/0263560 | A1 * | 12/2004 | Nakashima | 347/32 |

FOREIGN PATENT DOCUMENTS

| | | |
|---|---|---|
| JP | 02-198859 | 8/1990 |
| JP | 02198859 A | 8/1990 |
| JP | 06-000965 | 1/1994 |
| JP | 06000965 A | 1/1994 |

* cited by examiner

*Primary Examiner* — Stephen Meier
*Assistant Examiner* — Renee I Wilson
(74) *Attorney, Agent, or Firm* — DLA Piper LLP (US)

(57) ABSTRACT

A cleaning member capable of being attached and detached on a liquid ejecting apparatus, includes a substrate; and an elastic member which is provided on one side surface of the substrate and capable of contact with a liquid ejecting section included in the liquid ejecting apparatus.

6 Claims, 9 Drawing Sheets

CLEANING MEMBER AND LIQUID EJECTING APPARATUS

BACKGROUND

1. Technical Field

The present invention relates to a cleaning member and a liquid ejecting apparatus.

2. Related Art

As a liquid ejecting apparatus, an ink jet type printer has been known in which an image is printed on a paper by ejecting ink droplets from nozzles provided on a head. In an ink jet type printer, fine ink droplets may be generated with main ink droplets when the ink droplets are ejected from the nozzles. However, the fine ink droplets may lose speed thereof before landing on the paper and rebound from a paper surface or the like so that the ink droplets are carried away as mist and attaches to a nozzle opening surface of the head. In addition, dust, paper powder or the like also attaches to the nozzle opening surface as well as the ink mist. When a foreign matter attached to the nozzle opening surface is left and deposited, ejection of the ink droplets from the nozzles is inhibited and image quality of a printed image is degraded.

A method of cleaning has been disclosed in which the foreign matter attached to the nozzle opening surface is wiped by moving a wiper member configured of rubber or the like while being pressed against the nozzle opening surface of the head (see, for example, JP-A-6-965)

However, the foreign matter attached to the nozzle opening surface is not completely removed by only cleaning the head with the wiper member and then the foreign matter may remain on the nozzle opening surface. Then, the ejection of the ink droplets from the nozzles is inhibited. In addition, when the wiper member is separated from the head or the like, the foreign matter which is wiped by the wiper member may attach to a side surface of the head. The paper or a peripheral member is contaminated if the foreign matter attached to the side surface of the head is left.

SUMMARY

An advantage of some aspects of the invention is to provide a liquid ejecting apparatus including a liquid ejecting section (head) in which the foreign matter attached to the liquid ejecting section is removed as much as possible.

According to an aspect of the invention, there is provided a cleaning member capable of being attached and detached on a liquid ejecting apparatus, including a substrate; and an elastic member which is provided on one side surface of the substrate and capable of contact with a liquid ejecting section included in the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview

Figure 1:
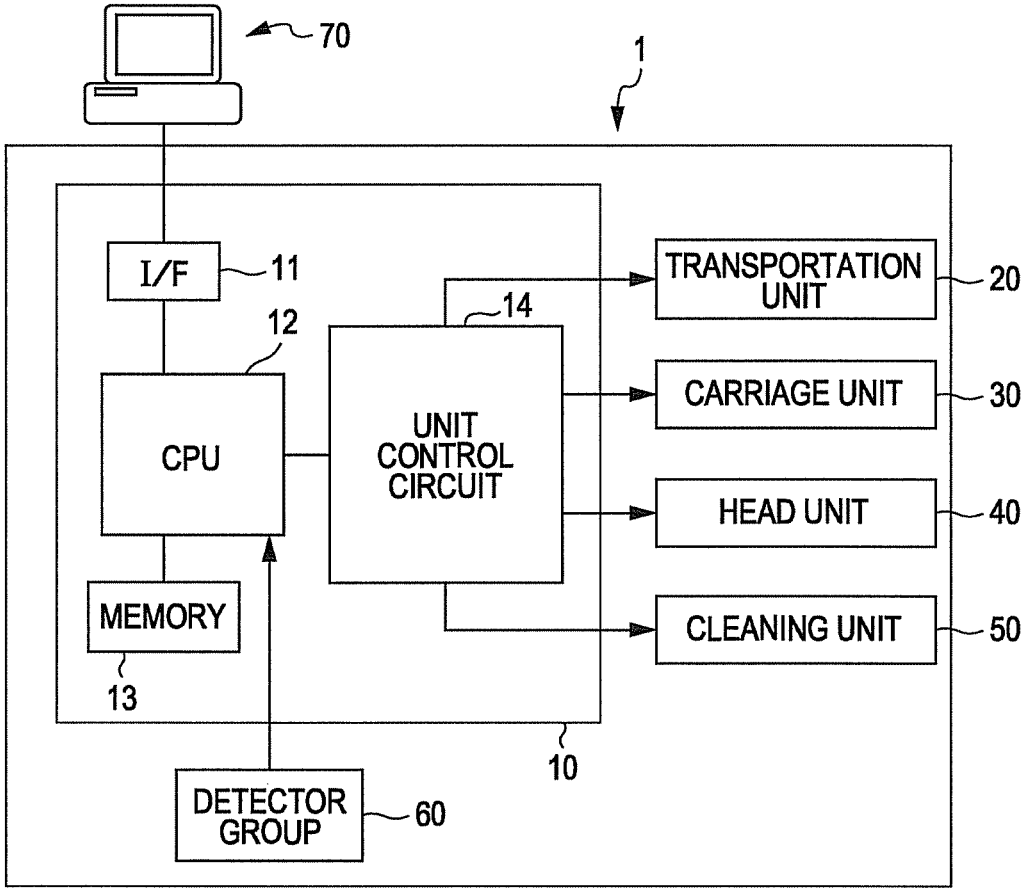
FIG. 1 is a block diagram illustrating an entire configuration of a printer.

At least following is apparent from the description of the specification and accompanying drawings.

In other words, a cleaning member capable of being attached and detached on a liquid ejecting apparatus, includes a substrate; and an elastic member which is provided on one side surface of the substrate and capable of contact with a liquid ejecting section included in the liquid ejecting apparatus.

According to the cleaning member, for example, the foreign matter which is not completely removed by the wiper member or the foreign matter attached to the surface which is not wiped by the wiper member can be removed from the liquid ejecting section (a head) and the foreign matter attached to the liquid ejecting section can be removed as much as possible.

In the cleaning member, the elastic member may have a fixing section of which the position is fixed to the substrate and a movable section which is a portion coming into contact with the liquid ejecting section and is provided so as to be displaceable with respect to the fixing section.

According to the cleaning member, a load applied to the liquid ejecting section can be reduced by the contact between the liquid ejecting section and the cleaning member while the liquid ejecting section reliably comes into contact with the cleaning member. In addition, tolerance of a shift of the installation position of the cleaning member can be increased.

In the cleaning member, the elastic member may have a bottom section which is a fixing section of which the position is fixed to the substrate and comes into contact with a liquid ejecting surface of the liquid ejecting section, and a recess section may be provided on a surface of one side of the bottom section and on a portion coming into contact with the liquid ejecting surface of the liquid ejecting section.

According to the cleaning member, the foreign matter removed from the liquid ejecting section by the elastic member can be dammed in the recess section. Thus, the foreign matter can be suppressed from being attached again on the liquid ejecting section and the liquid ejecting section can be in a cleaner state. In addition, it is possible to prevent the foreign matter from falling on a member other than the cleaning member (for example, a platen).

In the cleaning member, the elastic member may have a stepped section coming into contact with a side surface of the liquid ejecting section on a surface of the one side of the bottom section. The stepped section may have a fixing section of which the position is fixed to the substrate and a movable section which is a portion coming into contact with the side surface of the liquid ejecting section and is provided so as to be displaceable with respect to the fixing section. In addition, a recess section may be provided on a surface of one side of the bottom section and on a portion below the movable section.

According to the cleaning member, the foreign matter removed from the side surface of liquid ejecting section by the movable member can be dammed in the recess section and the liquid ejecting section can be in a further clean state.

In the cleaning member, an adhesive member may be provided on a surface of the other side of the substrate. A region in which the adhesive member is not provided may be present on an end portion in a direction intersecting a predetermined direction in which the cleaning member and the liquid ejecting section are relatively moved in the surface of the other side of the substrate.

According to the cleaning member, the installation position of the cleaning member can be finely adjusted and the installation of the cleaning member can be easily performed.

According to the another aspect of the invention, there is provided a liquid ejecting apparatus including a attaching-detaching section in which the above cleaning member is attached and detached; a liquid ejecting section which moves relative to the cleaning member in a predetermined direction; and a wiper member which moves relative to the liquid ejecting section in a direction intersecting the predetermined direction and removes foreign matter attached to a liquid ejecting surface of the liquid ejecting section.

According to the liquid ejecting apparatus, the foreign matter attached to the liquid ejecting section can be wiped in two directions and the foreign matter attached to the liquid ejecting section can be removed as much as possible.

Hereinafter, an embodiment will be described in which the liquid ejecting apparatus is a printer (an ink jet type printer) and the printer and the computer are connected to each other in a printing system as an example.

Printing System

Figure 2A:
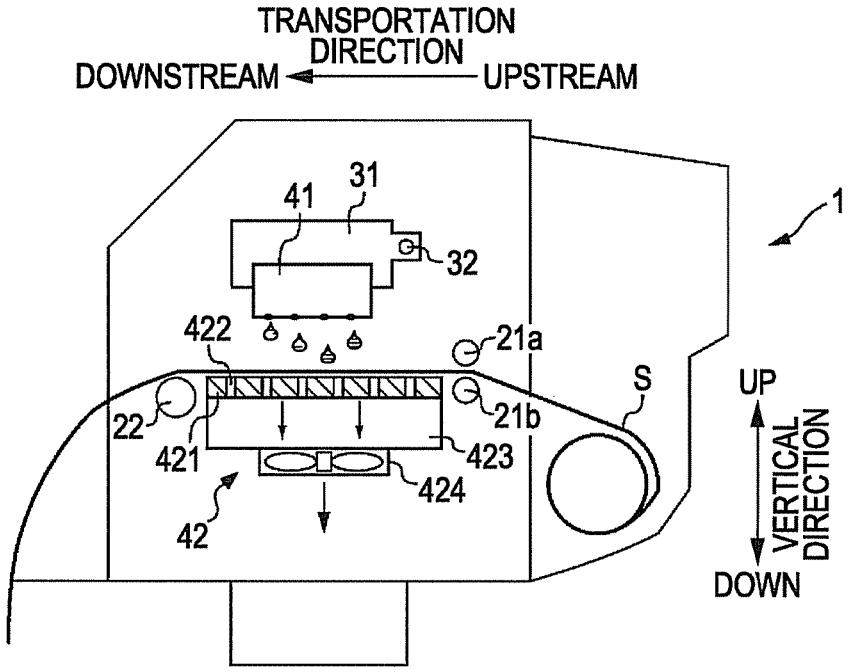
FIG. 2A is a schematic cross-sectional view of the printer.
Figure 2B:
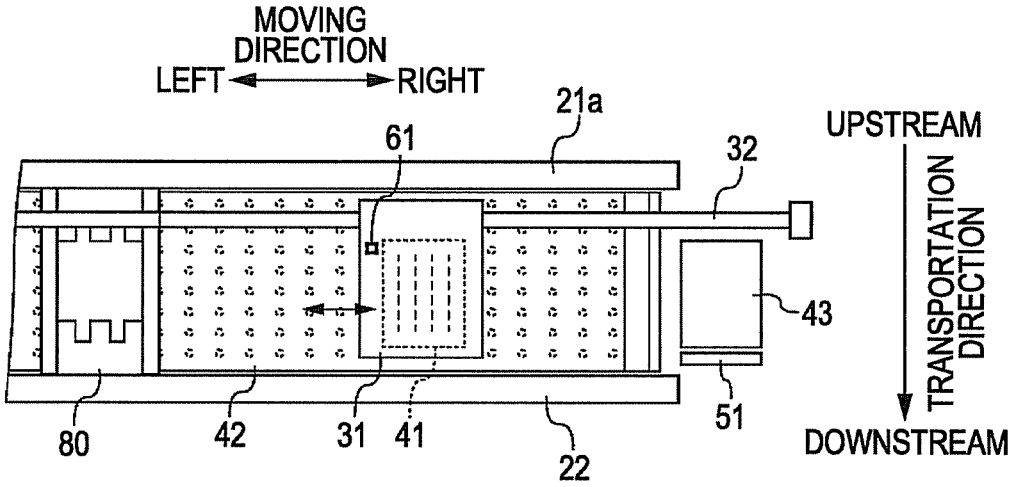
FIG. 2B is a schematic view of an image printing region viewed from top thereof.

FIG. 1 is a block diagram illustrating an entire configuration of a printer 1, FIG. 2A is a schematic cross-sectional view of the printer 1 viewed from a moving direction of a head 41, FIG. 2B is a schematic view of a region in which the image is printed by the head 41 viewed from the top thereof. The computer 70 is communicably connected to the printer 1 and printing data for printing the image on the printer 1 is output to the printer 1. A controller 10 inside the printer 1 is for performing an entire control in the printer 1. An interface section 11 performs receiving and transmitting of the data with the computer 70 that is an external device. A CPU 12 is an arithmetic processing unit for performing the entire control of the printer 1 and performing the control of each unit via a unit control circuit 14. A memory 13 is intended to ensure a storing region of program of the CPU 12, a working region or the like.

A transportation unit 20 feeds a paper S at a position capable of printing and is intended to transport the paper S downstream in the transportation direction with a predetermined transportation amount. In addition, the transportation unit 20 has a pair of transportation rollers (a transportation driving roller 21*a* and a transportation driven roller 21*b*) provided upstream more than the head 41 in the transportation direction and a paper discharging roller 22 provided downstream in the transportation direction from the head 41. In addition, in FIG. 2A, a continuous paper wound in a roll shape is exemplified, however, the invention is not limited to the embodiment and a cut paper may be used. In addition, the paper is used as a printing medium, however, the invention is not limited to the embodiment and, for example, fabric, plastic film or the like may be used.

A carriage unit 30 is intended to move the head 41 mounted on the carriage 31 along a guide rail 32 in a moving direction intersecting the transportation direction of the paper S.

The head unit 40 has the head 41 (corresponding to a liquid ejecting section) ejecting the ink on the paper S, a platen 42 supporting the paper S from a rear surface (a surface opposite to the printing surface) and a cap 43. A plurality of opening sections of the nozzles ejecting the ink are provided in the lower surface (a surface opposite to the paper S) of the head 41. In addition, an ink ejecting system from the nozzles may be a piezoelectric system which expands and contracts an ink chamber by applying a voltage on a driving element (a piezoelectric element) or a thermal system in which air bubbles are generated in the nozzle using a heating element and the ink is ejected from the nozzles with the air bubbles.

As illustrated in FIG. 2A, the platen 42 (corresponding to a attaching-detaching section) has a platen plate 421, a negative pressure chamber 423 and an adsorption fan 424, and adsorbs the paper S onto the upper surface of the platen plate 421. When operating the adsorption fan 424, the air inside the negative pressure chamber 423 is discharged to the outside and the inside of the negative pressure chamber 423 is in a negative pressure state. Then, the air on the platen plate 421 is sucked into the negative pressure chamber 423 and the paper S is sucked to the upper surface of the platen plate 421 via a plurality of adsorption holes 422 passing through the platen plate 421 in the vertical direction. As a result, the flatness of the paper S is ensured, a positional shift of the paper S can be prevented when printing is performed. However, the invention is not limited to the embodiment and, for example, the paper S may be electrostatically attracted to the platen.

The cap 43 is provided in a home position (a non printing region of a right end portion in the moving direction in FIG. 2B). The head 41 escapes to the home position when the printing is not performed and the nozzle opening surface of the head 41 is closed by the cap 43. Then, ink evaporation from the nozzles is suppressed and clogging of the nozzles can be prevented.

A cleaning unit 50 is intended to clean the head 41 and has a wiper member 51. The wiper member 51 moves with respect to the head 41 in the transportation direction in a state of abutting the nozzle opening surface of the head 41 and the foreign matter attach to the nozzle opening surface of the head 41 is removed.

A detectors group 60 is intended to monitor a situation inside the printer 1 and output the result of the detection to the controller 10. For example, a paper end detection sensor 61 detecting an end (present or absent of the paper S) of the paper S on the platen 42 is provided in the carriage 31.

In the printer 1 having such a configuration, an ejection operation in which the ink droplets are ejected while the head 41 moves in the moving direction and a transportation operation in which the paper S is transported downstream in the transportation direction are repeated alternately. As a result, a two dimensional image is printed on the paper S.

Cleaning of Head 41 by Wiper Member 51

Figure 3:
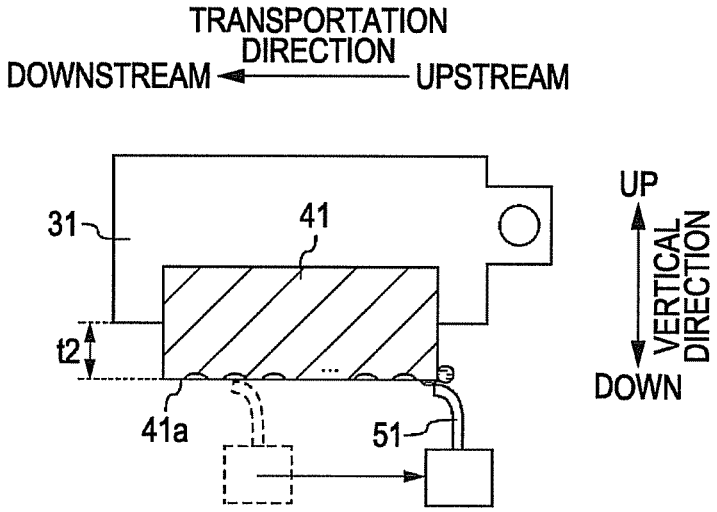
FIG. 3 is a view illustrating a method of cleaning a head with a wiper member.

FIG. 3 is a view illustrating a method of cleaning the head 41 by the wiper member 51. When the ink droplets are ejected from the nozzles, fine ink droplets may be generated after main ink droplets are ejected. The fine ink droplets lost speed thereof and rebound from the surface of the paper S before the fine ink droplets land on the paper S. Accordingly, the fine ink droplets are carried away from the paper S as mist and attach to the nozzle opening surface of the head 41. In addition, for example, in order to solve the clogging of the nozzles due to the thickened ink or the like, even though a closed space enclosing the nozzles is formed by a concave portion of the cap 43 and the closed space is a negative pressure and then the ink is sucked from the nozzles, the ink attaches to the nozzle opening surface. In addition, dust, paper powder or the like attaches to the nozzle opening surface as well as the ink.

When the foreign matter such as ink or the like, which attaches to the nozzle opening surface of the head 41, is left and deposited, the opening section of the nozzle is blocked and the ejection of the ink droplets from the nozzles is inhibited. For example, a defined amount of the ink is not ejected from the nozzles and a flying direction of the ink droplets ejected from the nozzles is shifted. As a result, the image quality of the printed image is degraded.

Thus, in the printer 1 of the embodiment, the wiper member 51 is provided in the home position. The wiper member 51 is a plate-shaped member formed of an elastic member such as fabric or rubber. When the head 41 is cleaned by the wiper member 51, first, the controller 10 makes the head 41 retract to the home position. After that, as illustrated in FIG. 3, the controller 10 moves the wiper member 51 from downstream to upstream in the transportation direction in a state where the wiper member 51 (the front end portion) abuts the nozzle opening surface 41*a* of the head 41. As a result, the foreign matter such as ink attaches to the nozzle opening surface 41*a* is wiped by the wiper member 51. In addition, as illustrated in FIG. 2B, a length of the wiper member 51 is the same as a length of the head 41 in the moving direction of the head 41 and a moving distance of the wiper member 51 is equal to or greater than the length of the head 41 in the transportation direction of the paper S. Accordingly, the wiper member 51 can wipe the entire the nozzle opening surface 41*a* only by moving the wiper member 51 one time in the transportation direction of the paper S.

However, the foreign matter attached to the nozzle opening surface 41*a* of the head 41 is not completely cleaned by cleaning of the head 41 using the wiper member 51 and the foreign matter remains in the nozzle opening surface 41*a*. Specifically, the wiper member 51 moves in only one direction (the transportation direction) with respect to the nozzle opening surface 41*a*. Thus, the foreign matter is raked by the wiper member 51 about a region of a side (here, upstream in the transportation direction) in which the wiper member 51 is moved in the nozzle opening surface 41*a* and the foreign matter easily remained. When the foreign matter remained in the nozzle opening surface 41*a* is deposited, the ejection of the ink droplets from the nozzles is inhibited and the image quality of the printed image is degraded.

In addition, when the wiper member 51 is separated from the nozzle opening surface 41*a* of the head 41, the foreign matter, which is raked by the wiper member 51, may attach to a side surface (a side surface in which the wiper member 51 is moved, here, a side surface upstream in the transportation direction) of the head 41. In addition, when the head 41 is cleaned using the wiper member 51 in which the foreign matter attach to its front end, the foreign matter reattaches to the side surface of the head 41. When the foreign matter, which attach to the side surface of the head 41, is left and deposited, there is a possibility that a problem occurs in which the paper S is contaminated or the foreign matter attaches to a periphery member.

Then, in the printer 1 of the embodiment, an object thereof is that the foreign matter attached to the head 41 is removed as much as possible. In particular, the object thereof is that any foreign matter which is not completely removed by the wiper member 51 and remaining on the nozzle opening surface 41*a* is reduced and the foreign matter attached to the side surface of the head 41 is removed.

Cleaning of Head 41 by Cleaning Mat 80

Figure 4A:
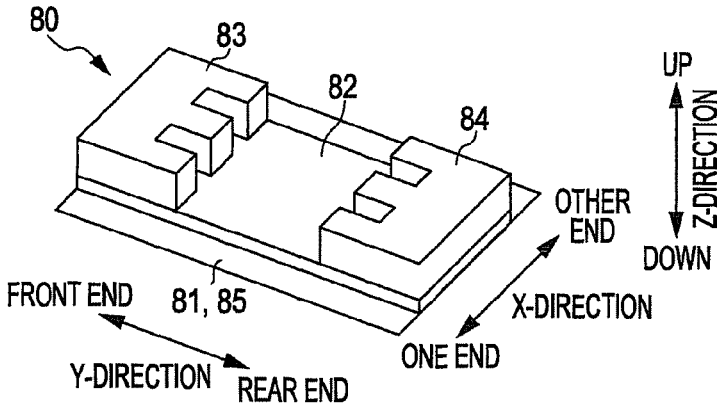
FIG. 4A is a perspective view of a cleaning mat.
Figure 4B:
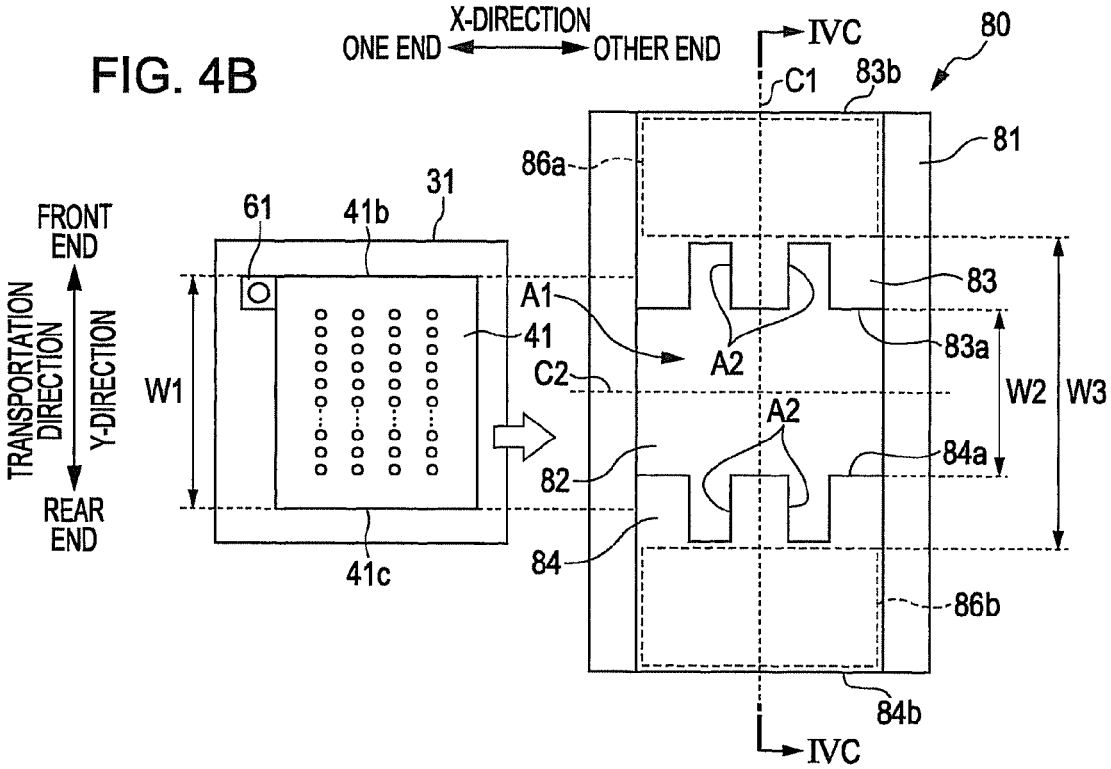
FIG. 4B is a top view of the cleaning mat and periphery of the head.
Figure 4C:
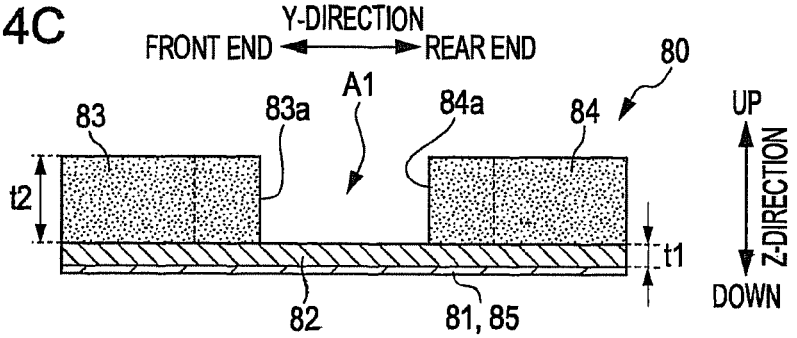
FIG. 4C is a cross-sectional view of the cleaning mat.
Figure 5A:
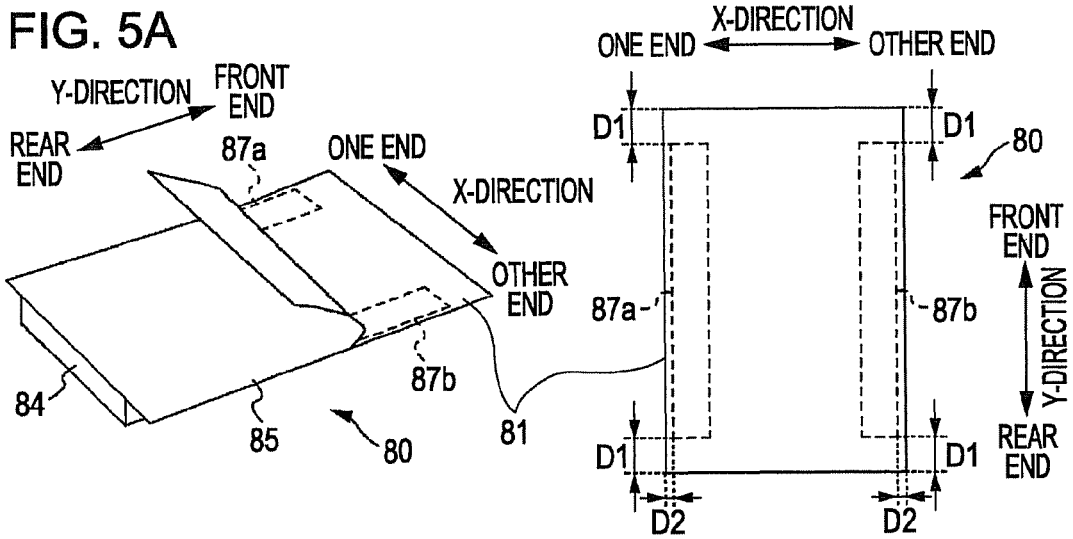
FIG. 5A is a view illustrating a peeling sheet and an adhesive member of a rear surface of the cleaning mat.
Figure 5B:
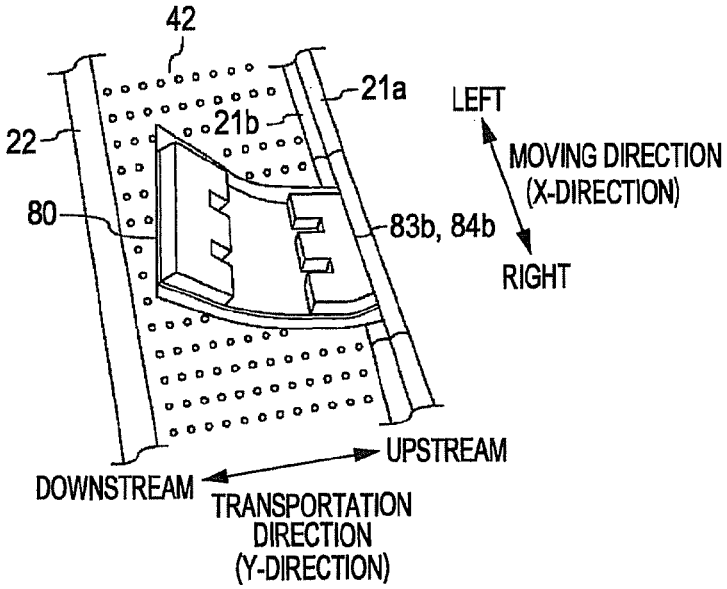
FIG. 5B is a view illustrating a method of installing the cleaning mat.
Figure 5C:
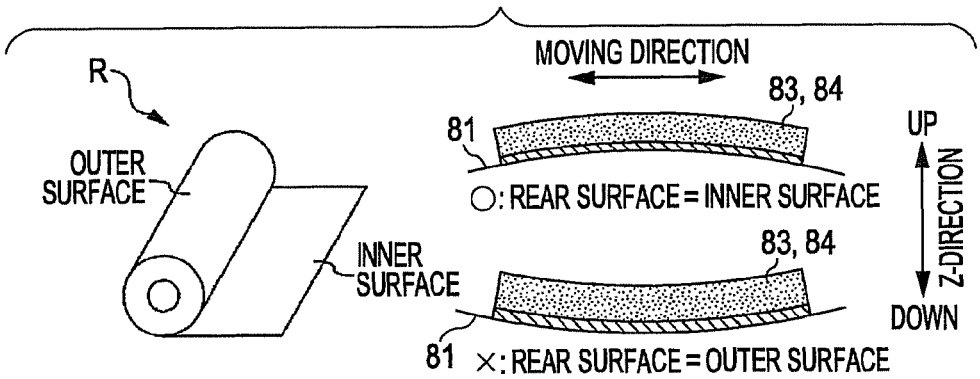
FIG. 5C is a view illustrating a case where a substrate is manufactured from a member which is wound in a roll shape.

FIG. 4A is a perspective view of a cleaning mat 80, FIG. 4B is a top view of the cleaning mat 80 and a periphery of the head 41 and FIG. 4C is a cross-sectional view of the cleaning mat 80. FIG. 5A is a view illustrating a peeling sheet 85 and adhesive members 87*a* and 87*b* in the rear surface of the cleaning mat 80, FIG. 5B is a view illustrating a method of installing the cleaning mat 80 on the platen 42 and FIG. 5C is a view illustrating a case where a substrate 81 is manufactured from a member R which is wound in a roll shape. In addition, in FIG. 4B, the head 41 or the paper end detection sensor 61 attached to the lower surface of the carriage 31 is virtually illustrated. In addition, FIG. 4C is a cross-sectional view taken in a center line IVC-IVC illustrated in FIG. 4B.

In the embodiment, other than the wiper member 51, the head 41 is cleaned by the cleaning mat 80 (corresponding to the cleaning member) capable of detaching and attaching in the printer 1 and including a substrate 81 and sponges 82 to 84 (elastic members) which is provided on the surface (one side surface) of the substrate 81, and capable of coming contact with the head 41. As illustrated in FIG. 2B, the cleaning mat 80 is provided on the platen 42 by a user. Accordingly, the platen 42 corresponds to an attaching-detaching section in which the cleaning mat 80 is attached and detached. After the cleaning mat 80 is provided, the controller 10 inside the printer 1 makes the head 41 to be moved in the moving direction by the carriage 31 so that the nozzle opening surface or the side surface of the head 41 comes in contact with the cleaning mat 80. As a result, the foreign matter such as ink attached to the head 41 is removed by the cleaning mat 80.

As described above, the cleaning of the head 41 is performed using the cleaning mat 80 in addition to the wiper member 51 so that the number of times wiping the foreign matter attached to the head 41 is increased and the foreign matter (specifically, the foreign matter attached to the side surface of the head 41), which is not wiped by the wiper member 51, can be removed. Thus, the foreign matter attached to the head 41 can be removed as much as possible. In addition, the head 41 can be held in a clean state rather than that the head 41 is cleaned only by the cleaning mechanism (the wiper member 51) originally included in the printer 1.

Cleaning Mat 80

The cleaning mat 80 has the substrate 81, the bottom section 82 provided on the front surface side (the upper surface side) of the substrate 81, the first stepped section 83 and the second stepped section 84 provided on the bottom section 82, the adhesive members 87*a* and 87*b* provided the rear surface side (the lower surface side) of the substrate 81 and the peeling sheet 85 covering the adhesive members 87*a* and 87*b*.

The substrate 81 is a rectangular-shaped sheet in which a longitudinal direction is Y direction and is formed of a flexible plastic sheet (for example, a nylon sheet). In addition, the substrate 81 is not limited to the plastic sheet and, for example, the substrate 81 may be formed of a metal plate, wood material or the like.

The bottom section 82 is a thin plate-shaped member in which the longitudinal direction is Y direction and is formed of the sponge. A thickness t1 (a length in the Z direction) of the bottom section 82 is the same as a distance (a so-called paper gap) from the nozzle opening surface 41*a* of the head 41 to the upper surface of the platen 42 (for example, 2.5 mm). In addition, the length of the bottom section 82 in the Y direction is the same as the length of the substrate 81 in the Y direction. However, the length of the bottom section 82 in the X direction is shorter than the length of the substrate 81 in the X direction. The bottom section 82 is provided on the substrate 81 so that the end portions (a front end and a rear end) of the substrate 81 and the bottom section 82 in the Y direction are aligned, and the center portion (C1) of the substrate 81 and the bottom section 82 in the X direction is aligned. Accordingly, both end portions of the substrate 81 in the X direction have regions in which the bottom section 82 is not provided. In addition, the position of the bottom section 82 (a fixed section) is fixed to the substrate 81 and comes in contact with the nozzle opening surface of the head 41.

The first stepped section 83 and the second stepped section 84 (hereinafter, two are also referred to as "stepped section") are members having a substantially rectangular shape and are formed of the sponge. The first stepped section 83 is provided in the front end side in the Y direction in the upper surface of the bottom section 82 and the second stepped section 84 is provided in the rear end side in the Y direction. As illustrated in FIG. 4C, a space A1 exists between the first stepped section 83 and the second stepped section 84. The space A1 is a region through which the head 41 passes. In addition, the length of the stepped sections 83 and 84 in the X direction is the same as the length of the bottom section 82 in the X direction, and the end portions of the stepped sections 83 and 84 and the bottom section 82 in the X direction are aligned. Accordingly, both end portions of the substrate 81 in the X direction have regions in which the bottom section 82 and the stepped sections 83 and 84 are not provided. A thickness t2 of the stepped sections 83 and 84 is thicker than the thickness t1 of the bottom section 82 and, in the embodiment, is the same as a length t2 of the side surface of the head 41 protruded from the bottom surface of the carriage 31 (for example, 10 mm).

In addition, two rectangular shape groove sections A2 are provided in a side surface 83*a* of the first stepped section 83 on the rear end side in the Y direction and in a side surface 84*a* (in other words, a side surface on the space A1 side) of the second stepped section 84 in the Y direction, respectively. Two groove sections A2 of each of stepped sections 83 and 84 are symmetrically disposed with respect to the center line IVC-IVC of the cleaning mat 80 in the X direction.

In addition, the bottom section 82, the first stepped section 83 and the second stepped section 84 are separated bodies (capable of separating), and the lower surface of each of the stepped sections 83 and 84 and the upper surface of the bottom section 82 are adhered with the adhesive members 86*a* and 86*b*. However, the lower surface of the stepped sections 83 and 84 has a region in which the bottom section 82 is not adhered, that is, the adhesive members 86*a* and 86*b* are not provided. In particular, a region (a movable portion) in which the groove sections A2 is provided in the rear end side of the first stepped section 83 in the Y direction is not adhered to the bottom section 82. A region 86*a* (a fixed portion) of the front end side from the groove sections A2 in the Y direction is adhered to the bottom section 82 and the position thereof is fixed to the substrate 81. A region (a movable portion) in which the groove sections A2 is provided in the front end side of the second stepped section 84 in the Y direction is not adhered to the bottom section 82. A region 86*b* (a fixed portion) of the rear end side from the groove sections A2 in the Y direction is adhered to the bottom section 82 and the position thereof is fixed to the substrate 81. That is, three portions of the stepped sections 83 and 84 branched by the groove sections A2 displaceable with respect to the bottom section 82 and the substrate 81. In other words, the first stepped section 83 and the second stepped section 84 have the fixed portion of which the position is fixed to the substrate 81 and the movable portion (the three portions branched by the groove sections A2) which is a portion coming into contact with the side surface of the head 41 and is displaceable with respect to the fixed portion, respectively.

Then, as illustrated in FIG. 2B, the cleaning mat 80 is disposed on the platen 42 so that Y direction of the cleaning mat 80 extends along the transportation direction of the printer 1 and X direction of the cleaning mat 80 extends along the moving direction of the head 41. In this state, when controller 10 makes the head 41 to be moved in the moving direction, the head 41 passes through the space A1 of the cleaning mat 80. As described above, the thickness of the bottom section 82 of the region A1 through which the head 41 passes is substantially the same as the paper gap. Thus, the head 41 passes through the cleaning mat 80 while the nozzle opening surface 41*a* comes in contact with the sponge (the bottom section 82) without being caught by the bottom section 82. As a result, the foreign matter, which is not completely removed by the wiper member 51 and remained on the nozzle opening surface 41*a* of the head 41, is removed (wiped) by the bottom section 82.

In addition, cleaning mat 80 has the stepped sections 83 and 84 (the sponges which are higher than the bottom section 82) on the front end side and the rear end side from the region A1 through which the head 41 passes in the Y direction. In other words, the height of the region of the front end side and the rear end side in the Y direction from the substrate 81 is higher than the region A1 through which the head 41 passes. Thus, the head 41 passes through the cleaning mat 80 while side surfaces 41*b* and 41*c* in the transportation direction come in contact with the sponges (the stepped sections 83 and 84). As a result, the foreign matter attached to the side surfaces 41*b* and 41*c* of the head 41 is removed from the stepped sections 83 and 84.

In addition, cleaning mat 80 has the sponge (the elastic member) so as to surround the nozzle opening surface 41*a* and the side surfaces 41*b* and 41*c* of the head 41. Thus, the foreign matter attached to a corner portion of the head 41 can be removed. In addition, it is possible to prevent the foreign matter which is wiped from the nozzle opening surface 41*a* being moved and attached again to the side surfaces 41*b* and 41*c* or the foreign matter which is wiped from the side surfaces 41*b* and 41*c* is moved and attached again to the nozzle opening surface 41*a*.

In addition, the wiper member 51 included in the printer 1 of the embodiment moves in the transportation direction (the direction intersecting a predetermined direction) with respect to the head 41 (the liquid ejecting section) while the head 41 moves in the moving direction (a predetermined direction) with respect to the cleaning mat 80. In other words, the direction in which the wiper member 51 wipes the foreign matter on the nozzle opening surface 41*a* (the liquid ejecting surface) of the head 41 is different from the direction in which the cleaning mat 80 wipes the foreign matter on the head 41 by moving of the head 41 by 90 degrees. Thus, for example, the foreign matter, which is raked by the wiper member 51 but is not completely removed, can be wiped by the cleaning mat 80. In other words, the foreign matter can be removed from the head 41 as much as possible by wiping the foreign matter attached to the head 41 in two directions.

In addition, if a user installs the cleaning mat 80 in wrong direction by mistake, that is, Y direction of the cleaning mat 80 extends along the moving direction of the head 41, the head 41 moving in the moving direction collides the stepped sections 83 and 84. It can be detected that the installation direction of the cleaning mat 80 is incorrect by the collision. The user can be informed of it. In addition, if the user forgets to remove the cleaning mat 80 from the platen 42 after the head 41 is cleaned by the cleaning mat 80, the paper S transported in the transportation direction collides with the stepped sections 83 and 84. The forgetting of removing the cleaning mat 80 can be detected by the collision and the user can be informed of it. In other words, error of the installation direction of the cleaning mat 80 and the forgets of removing of the cleaning mat 80 can be detected as well as the foreign matter is removed from the side surface of the head 41 by the stepped sections 83 and 84.

In addition, the stepped sections 83 and 84 of the cleaning mat 80 have regions which that are not adhered to the bottom section 82. For example, if the entire region of the stepped sections 83 and 84 is fixed to the bottom section 82, the fixed stepped sections 83 and 84 collide with the head 41 and the head 41 stops when the installation position of the cleaning mat 80 is slightly shifted in the transportation direction. Then, the cleaning of the head 41 by the cleaning mat 80 is suspended. In addition, a load is applied to the head 41 or the carriage 31 by the collision against the stepped sections 83 and 84 and leads to the cause of the failure of the carriage 31 and the head 41. In addition, conversely, when the width of the space A1 is large in order to prevent the collision between the fixed stepped sections 83 and 84, and head 41, the side surfaces 41*b* and 41*c* of the head 41 do not come in contact with the stepped sections 83 and 84, and the foreign matter cannot be removed from the side surfaces 41*b* and 41*c* of the head 41.

Accordingly, as the cleaning mat 80 of the embodiment, it is preferable that the region, which is not adhered to the bottom section 82, be provided in the stepped sections 83 and 84. In other words, the sponge (the elastic member) provided on the substrate 81 is intended to have the fixed portion (the bottom section 82 and a portion of the stepped sections 83 and 84 adhered to the bottom section 82) of which the position is fixed with respect to the substrate 81 and the movable portion (a portion of the stepped sections 83 and 84 which are not adhered to the bottom section 82) which comes in contact with the head 41 and is provided to be displaceable with respect to the fixed portion. In addition, the length W2 from the side surface 83*a* of the first stepped section 83 on the rear end side in the Y direction to the side surface 84*a* of the second stepped section 84 on the front end side in the Y direction is narrower than the length W1 of the head 41 protruded from the carriage 31 in the transportation direction and a length W3 from the adhesive region 86*a* of the first stepped section 83 to the adhesive region 86*b* of the second stepped section 84 in the Y direction is wider than the length W1 (W2<W1<W3).

By doing this, it is possible to prevent the head 41 from stopping by coming into contact with the stepped sections 83 and 84. The load applied to the head 41 or the carriage 31 can be reduced when the head 41 comes into contact with the stepped sections 83 and 84. In addition, the side surfaces 41*b* and 41*c* of the head 41 in the transportation direction can be reliably come into contact with the stepped sections 83 and 84, the foreign matter attached to the side surfaces 41*b* and 41*c* of the head 41 can be removed. In addition, tolerance of a shift of the installation position of the cleaning mat 80 in the transportation direction can be increased and the cleaning mat 80 can be easily installed.

In addition, the groove sections A2 is provided in the side surfaces 83*a* and 84*a* in which each of stepped sections 83 and 84 comes into contact with the head 41. Thus, the foreign matter wiped from the side surfaces 41*b* and 41*c* of the head 41 can be dammed in the groove sections A2 and the foreign matter can be removed from the side surfaces 41*b* and 41*c* as much as possible. In addition, the foreign matter can be also removed from the side surfaces 41*b* and 41*c* as much as possible by increasing the area of the sponge coming into contact with the head 41 with the groove sections A2. In other words, since three portions of each of the stepped sections 83 and 84 branched by the groove sections A2 are oscillated, respectively, and the foreign matter is removed from the side surfaces 41*b* and 41*c* of the head 41, the foreign matter can be removed from the side surfaces 41*b* and 41*c* as much as possible.

In addition, the length of the substrate 81 in the X direction is longer than the length of the bottom section 82 and the stepped sections 83 and 84 in the X direction and the both end portions of the substrate 81 in the X direction has the regions in which sponge (the bottom section 82 and the stepped sections 83 and 84) is not provided. Thus, the foreign matter, which is removed from the head 41 by moving of the head 41 while coming into contact with the bottom section 82 or the stepped sections 83 and 84, is received in the both end portions of the substrate 81 in the X direction. Thus, the foreign matter can be prevented from falling on the platen 42 and the platen 42 or the paper S can be prevented from being contaminated.

In addition, in the embodiment, the bottom section 82 and the stepped sections 83 and 84 are not limited to the sponge (a porous member). The bottom section 82 and the stepped sections 83 and 84 may be formed of a material which can remove the foreign matter from the head 41 and, for example, may be formed of an elastic member such as rubber, thermoplastic elastomer, fabric, nonwoven fabric and a brush. However, it is preferable that the bottom section 82 and the stepped sections 83 and 84 be formed of a member having resistance against the ink ejected from the head 41, that is, a member which does not deteriorate even in contact with the ink. Particularly, the bottom section 82 or the like may be configured of the elastic member having ink resistance or the bottom section 82 or the like may be configured by covering the elastic member with a member having the ink resistance. By doing this, it is possible to prevent the bottom section 82 or the stepped sections 83 and 84 from being deteriorated (for example, cured) and the head 41 is adversely affected (for example, the head 41 is scratched) by the ink removed from the head 41. In addition, it is preferable that the bottom section 82 and the stepped sections 83 and 84 be formed of a member which does not react the ink and does not change the nature of the ink. By doing this, the ink droplets can be normally ejected from the nozzle and the image quality of the printing image can be prevented from deteriorating.

In addition, as illustrated in FIG. 5A, the rear surface (corresponding to the adhesive surface with the platen 42 and the other side surface) of the substrate 81 has the adhesive members 87*a* and 87*b* (for example, a double-sided tape) for fixing the cleaning mat 80 to the platen 42. Then, the cleaning mat 80 is supplied the user in a state where the peeling sheet 85 covering the adhesive members 87*a* and 87*b* is adhered to the rear surface of the substrate 81. The adhesive members 87*a* and 87*b* provided on the rear surface of the substrate 81 is a member (adhesion strength) capable of peeling again and adhering again with respect to the upper surface of the platen 42. By doing this, the cleaning mat 80 can be easily removed from the platen 42 and the adhesive members 87*a* and 87*b* can be prevented from remaining in the platen 42. In addition, even though the user installs the cleaning mat 80 in a wrong direction by mistake, the cleaning mat 80 can be installed again in the correct position. In addition, the cleaning mat 80 can be used again.

Meanwhile, the installation position of the cleaning mat 80 is important in the transportation direction (the Y direction) rather than the moving direction (the X direction) so that the head 41 passes through the region A1 between the stepped sections 83 and 84. Then, in the embodiment, as illustrated in FIG. 5B, a position, in which the front end portion 83*b* of the first stepped section 83 or the rear end portion 84*b* of the second stepped section 84 abuts the transportation driving roller 21*a*, is the installation position of the cleaning mat 80. Thus, the length of the stepped sections 83 and 84 in the Y direction is set according to the distance from the transportation driving roller 21*a* to the head 41 in the transportation direction. In other words, the stepped sections 83 and 84 also function as a reference of the installation position of the cleaning mat 80 in the transportation direction.

In addition, as illustrated in FIG. 5A, the adhesive members 87*a* and 87*b* provided on the rear surface of the substrate 81 extend along the Y direction in the both end portions in the X direction. However, an interval D1 from the end of the substrate 81 in the Y direction to the adhesive members 87*a* and 87*b* in the Y direction is wider than an interval D2 from the end of the substrate 81 in the X direction to the adhesive members 87*a* and 87*b* in the X direction (D1>D2). In other words, the adhesive members 87*a* and 87*b* are provided to the end of the rear surface of the substrate 81 in the X direction, however, the end portion of the rear surface of the substrate 81 in the Y direction has regions in which the adhesive members 87*a* and 87*b* are not provided. In other words, the adhesive members 87*a* and 87*b* are not provided on the entire region of the end portion of the rear surface of the substrate 81 in the Y direction and the adhesive members 87*a* and 87*b* are provided on the region other than the end portion in the Y direction.

If the adhesive member is provided to the end portion of the rear surface of the substrate 81 in the Y direction, since the position of the cleaning mat 80 is fixed to the position on which the substrate 81 initially comes into contact with the platen 42, the installation of the cleaning mat 80 is difficult. Thus, the cleaning mat 80 can slide until abutting the transportation driving roller 21*a* by not providing the adhesive member on the end portion of the rear surface of the substrate 81 in the Y direction, in a state where the end portion (in other words, the portion on which the adhesive member is not provided) of the rear surface of the substrate 81 in the Y direction does not comes into contact with the platen 42. In other words, the installation position of the cleaning mat 80 can be finely adjusted and the installation of the cleaning mat 80 can be easily performed.

Meanwhile, the end portions of the rear surface of the substrate 81 in the X direction (the moving direction) have the adhesive members 87*a* and 87*b* to the end of the substrate 81. However, the paper gap is a small space. Thus, when the end portion of the substrate 81 in the X direction is lifted from the platen 42, the head 41 and the substrate 81 collide. Then, the head 41 stops and the cleaning of the head 41 by the cleaning mat 80 is suspended. In addition, the load is applied to the head 41 or the carriage 31 by the collision with the substrate 81 and the collision leads to the cause of the failure. In addition, the head 41 is scratched in the end portion of the substrate 81. Thus, it is preferable that the adhesive members 87*a* and 87*b* be provided to the end of the rear surface of the substrate 81 in the X direction and the substrate 81 be prevented from lifting from the platen 42.

In addition, as illustrated in FIG. 5C, when the substrate 81 is manufactured from the plastic sheet R wound in the roll shape, the substrate 81 may have winding habit. In this case, if the inner surface of the plastic sheet R wound in the roll shape is the front surface (the upper surface) of the substrate 81 and the outer surface thereof is the rear surface (the lower surface) of the substrate 81, the end portion of the substrate 81 in the X direction (the moving direction) is easily lifted from the platen 42 (the adhesive members 87*a* and 87*b* are easily peeled from the platen 42) and the substrate 81 and the head 41 collide. Thus, the substrate 81 is manufactured so that the outer surface of the plastic sheet R wound in the roll shape is the front surface of the substrate 81 and the inner surface thereof is the rear surface of the substrate 81. In addition, the substrate 81 is manufactured so that the front surface side of the substrate 81 is curved in a convex shape. Then, even though the winding habit remains in the substrate 81, it is possible to prevent the end portion of the substrate 81 in the X direction from being lifted from the platen 42.

In addition, the cleaning mat 80 of the embodiment has a symmetrical shape with respect to the center line IVC-IVC in the X direction and has a symmetrical shape with respect to the center line C2 in the Y direction. Thus, the user needs only to install the Y direction of the cleaning mat 80 along the transportation direction without considering whether the front end portion of the cleaning mat 80 in the Y direction toward either side of the transportation direction. Accordingly, the installation of the cleaning mat 80 can be easily performed.

Method of Cleaning Head 41 by Cleaning Mat 80

Figure 6:
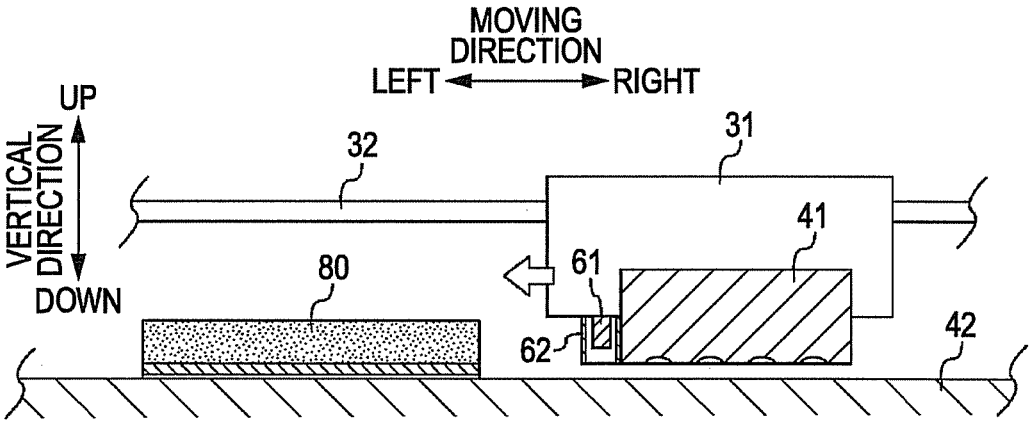
FIG. 6 is a view illustrating a method of cleaning the head using the cleaning mat.

FIG. 6 is a view illustrating a method of cleaning the head 41 by the cleaning mat 80. For example, according to a predetermined period of time, for every print job of predetermined number, the cleaning of the head 41 may be carried out by the cleaning mat 80 according to the degree of contamination or the like of the head 41. In addition, the printer 1 or the computer 70 may instruct the user the timing of the cleaning and the user may manage the timing of the cleaning.

The cleaning of the head 41 by the cleaning mat 80 is carried out in a state where the print stops and the head 41 positions in the home position. First as illustrated in FIG. 5A, the user peels the peeling sheet 85 attached to the rear surface of the cleaning mat 80 and slide the cleaning mat 80 in the transportation direction in a state where the end portion (the portion in which the adhesive members 87*a* and 87*b* are not provided) of the cleaning mat 80 in the Y direction comes into contact with the upper surface of the platen 42. Then, when the stepped sections 83 and 84 of the cleaning mat 80 abut the transportation driving roller 21*a*, the user places the cleaning mat 80 (the entire rear surface of the substrate 81) on the platen 42 and fixes the position of the cleaning mat 80 with the adhesive members 87*a* and 87*b* provided on the rear surface of the substrate 81. In addition, since the sponge (the bottom section 82 and the stepped sections 83 and 84) is not provided in the both end portions of the substrate 81 in the X direction, the portion of the substrate 81, in which the adhesive members 87*a* and 87*b* are provided, can be fixed to the platen 42 (the user can trace from above the substrate 81 with a finger).

When the installation of the cleaning mat 80 is completed, the controller 10 inside the printer 1 allows the head 41 to move one time to the left side in the moving direction by the carriage 31 once. At this time, since the head 41 passes through the space A1 between the first stepped section 83 and the second stepped section 84 of the cleaning mat 80, the foreign matter attached to the nozzle opening surface 41*a* or the side surfaces 41*b* and 41*c* of the head 41 is removed by the cleaning mat 80.

However, in the printer 1 of the embodiment, the lower surface of the carriage 31 has the paper end detection sensor 61 and a sensor cover 62 to protect the paper end detection sensor 61. When the foreign matter attaches to the lower surface (in other words, a surface in which the paper end detection sensor 61 faces the platen 42) of the sensor cover 62, detection precision of the paper end detection sensor 61 is degraded. Thus, it is preferable that the sensor cover 62 also come into contact with the sponge (the bottom section 82 or the stepped sections 83 and 84) of the cleaning mat 80. By doing this, the foreign matter attached to the sensor cover 62 can be removed and the detection precision of the paper end detection sensor 61 can be prevented from degrading. In addition, in a case where the paper end detection sensor 61 is not protected by the sensor cover 62, the paper end detection sensor 61 may come into contact with the cleaning mat 80.

However, the head 41 comes into contact with the cleaning mat 80 earlier than the sensor cover 62, the sensor cover 62 comes into contact with the cleaning mat 80 in a state where the foreign matter removed from the head 41 is attached to the cleaning mat 80 and then there is a concern that the sensor cover 62 may be contaminated conversely. Thus, the sensor cover 62 (or the paper end detection sensor 61) comes into contact with the cleaning mat 80 earlier than the head 41. Thus, for example, as illustrated in FIG. 6, in a case where the sensor cover 62 is installed to the left side than the head 41 in the moving direction, the cleaning mat 80 is installed at a position on the left side than the head 41 in the moving direction and the head 41 may move to the left side in the moving direction. By doing this, the lower surface (the surface in which the paper end detection sensor 61 faces the platen 42) of the sensor cover 62 can be kept clean in a state where the foreign matter is not attached and the detection precision of the paper end detection sensor 61 can be prevented from degrading.

In addition, in the embodiment, the head 41 is moved one time with respect to the cleaning mat 80 in the moving direction once, however, the invention is not limited to the embodiment. The head 41 may reciprocate in the moving direction a plurality of times and the cleaning mat 80 may come into contact with the head 41*a* plurality of times.

Modification Example of Cleaning Mat 80

Figure 7A:
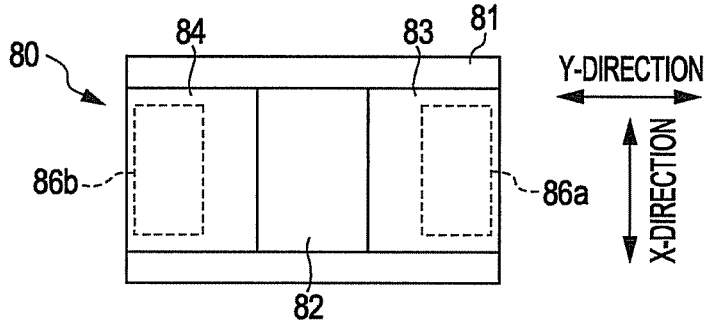
FIGS. 7A to 7E are views illustrating modification examples of the cleaning mat.

FIGS. 7A to 7E are views illustrating modification examples of the cleaning mat 80. In the cleaning mat 80 (FIG. 4) described above, the groove sections A2 is provided in the first stepped section 83 and the second stepped section 84, however, the invention is not limited to the embodiment. As illustrated in FIG. 7A, the cleaning mat 80 may be included in which the groove section is not provided in the stepped sections 83 and 84. According to the cleaning mat 80 in FIG. 7A, the method of manufacturing can be simplified (reduction in man-hours). In addition, the cleaning mat 80 may be included in which the groove section is provided in any one of the first stepped section 83 and the second stepped section 84. In addition, the shape of the groove section present invention the stepped sections 83 and 84 is not limited to the rectangular-shaped and, for example, the shape may be a semi-cylindrical or a triangular column, and the number of the groove sections A2 also is not limited to two and may be one or three or more. In addition, the shapes of the groove sections or the number of the groove sections may be different from each other in the first stepped section 83 and the second stepped section 84. In addition, the heights (the lengths in the Z direction) or the lengths in the Y direction of the first stepped section 83 and the second stepped section 84 may be different from each other.

Figure 7B:
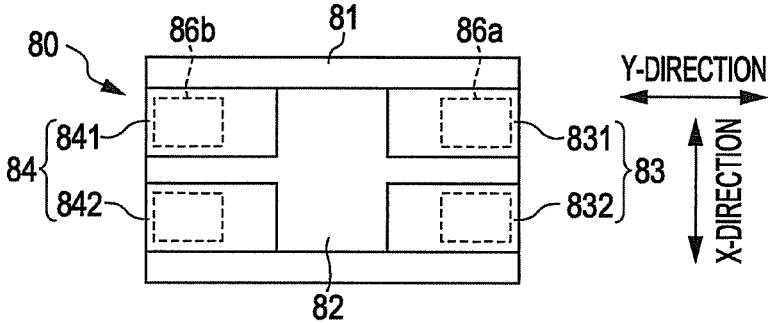

In addition, as illustrated in FIG. 7B, the cleaning mat 80 may be included in which one stepped section (83 or 84) is configured of two rectangular-shaped sponges (831 and 832 or 841 and 842). The two rectangular-shaped sponges (831 and 832 or 841 and 842) are disposed with a space in the X direction so that the foreign matter removed from the head 41 can be dammed in the space. In addition, since the area of the sponge coming into contact with the head 41 is increased, the foreign matter can be removed as much as possible.

Figure 7C:
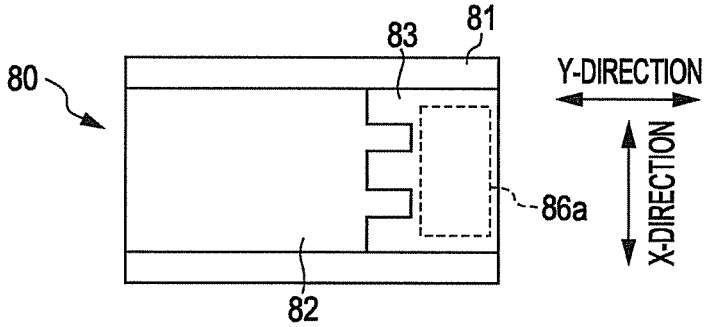

In addition, as illustrated in FIG. 7C, the cleaning mat 80 may be included in which the stepped section 83 is provided on one side in the Y direction. In the printer 1 of the embodiment, the wiper member 51 moves upstream in the transportation direction. Thus, when the wiper member 51 is separated from the head 41, the foreign matter is specifically easy to be attached on the side surface of the head 41 upstream in the transportation direction. Thus, internal configuration the cleaning mat 80 in FIG. 7C, the portion in which the stepped section 83 is provided may be disposed so as to be positioned upstream in the transportation direction. According to the cleaning mat 80 in FIG. 7C, the method of manufacturing can be simplified and reduction of the cost is achieved.

Figure 7D:
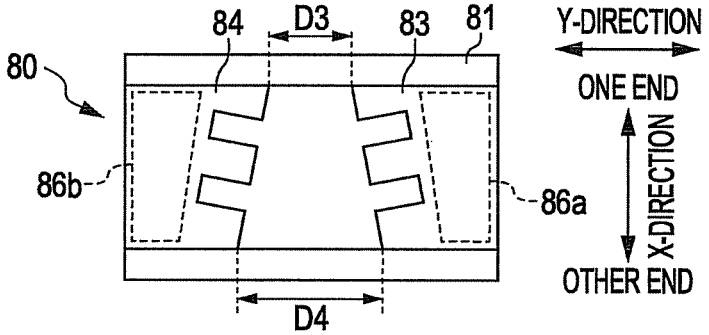

In addition, in the cleaning mat 80 (FIG. 4B) described above, the interval W2 of the stepped sections 83 and 84 in the Y direction is constant, however, the invention is not limited to the embodiment. As illustrated in FIG. 7D, the cleaning mat 80 may be included in which the interval (the interval between the side surfaces 83*a* and 84*a* of the stepped sections coming into contact with the side surfaces 41*b* and 41*c* of the head) of the stepped sections 83 and 84 in the Y direction is configured such that the other end side thereof is wider than one end side in the X direction (D3<D4). Then, the cleaning mat 80 is disposed according one end side in the X direction to the side of the head 41 being moved so that the head 41 moves from the wide side of the interval of the stepped sections 83 and 84 in the Y direction to the narrow side. By doing this, the foreign matter removed from the head 41 easily stays on the cleaning mat 80 and the foreign matter can be removed from the head 41 as much as possible. In addition, as illustrated in FIG. 7D, the interval may be gradually widened by inclining the side surfaces 83*a* and 84*a* of the stepped sections in the X direction. In addition, the interval may be widened in the middle of the side surfaces 83*a* and 84*a* of the stepped sections (not illustrated).

Figure 7E:
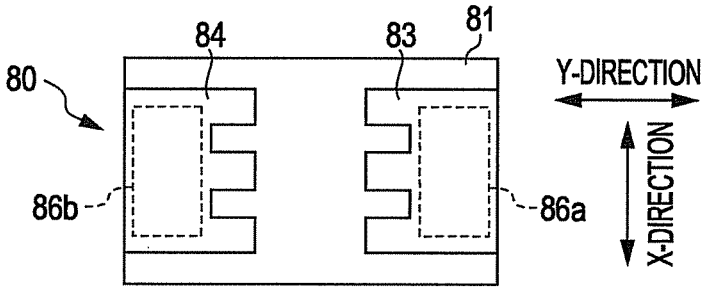

In addition, as illustrated in FIG. 7E, the cleaning mat 80 may be included in which the bottom section 82 is absent and the stepped sections 83 and 84 are directly provided on the substrate 81. Even in the cleaning mat 80, the foreign matter can, be removed from the side surfaces 41*b* and 41*c* of the head 41. Conversely, the cleaning mat 80 may be included in which the stepped sections 83 and 84 are absent and only the bottom section 82 is provided on the substrate 81. Even in the cleaning mat 80, the foreign matter can be removed from the nozzle opening surface 41*a* of the head 41. According to the cleaning mat 80, the method of manufacturing can be simplified and the reduction of the cost can be achieved.

In addition, the cleaning mat 80 described above has the region in which the adhesive members 86*a* and 86*b* are not provided between the bottom section 82 and the stepped sections 83 and 84, however, the invention is not limited to the embodiment. The adhesive member is provided on the entire region of the lower surface of the stepped sections 83 and 84, and the portions of the stepped sections 83 and 84 capable of displacing with respect to the bottom section 82 and the substrate 81 may be provided.

In addition, in the cleaning mat 80 described above, the adhesive member is provided in the both end portions in the rear surface of the substrate 81 in the Y direction, however, the invention is not limited to the embodiment. For example, the adhesive member may be provided in one side end portion of the both end portions in the Y direction and the adhesive member may be provided in a portion of the end portion in the Y direction. In this case, the portion, in which the adhesive member is not provided in the end portion of the rear surface of the substrate 81 in the Y direction, comes into contact with the platen 42 and then the position adjustment of the cleaning mat 80 may be performed. In addition, the adhesive member may be provided in the center portion of the rear surface of the substrate 81.

In addition, in cleaning mat 80 described above, the bottom section 82 and two stepped sections 83 and 84 are separated bodies (separable), respectively, and they are adhered with the adhesive members 86*a* and 86*b*, however, the invention is not limited to the embodiment. The bottom section 82 or the stepped sections 83 and 84 may be integrally formed. In other words, a rectangular-shaped sponge is machined and the stepped sections 83 and 84, the groove sections A2 or the like may be formed. In addition, the bottom section 82 and the stepped sections 83 and 84 may be formed with different elastic members.

In addition, in the cleaning mat 80 described above, the both end portions of the front surface of the substrate 81 in the X direction has the region in which the sponge (the bottom section 82 and the stepped sections 83 and 84) is not provided, however, the invention is not limited to the embodiment. The cleaning mat 80 may be included in which even in the both end portions of the front surface of the substrate 81 in the X direction, the sponge is provided. In addition, the cleaning mat 80 may be included which has the region in which the sponge is not provided only in one side end portion of the both end portions of the front surface of the substrate 81 in the X direction.

In addition, in the cleaning mat 80 described above, the position thereof is fixed to on the platen 42 by the adhesive members 87*a* and 87*b* provided on the rear surface of the substrate 81, however, the invention is not limited to the embodiment. In the printer 1 (FIG. 2A) of the embodiment, the paper S is adsorbed by the adsorption fan 424 to be adsorbed on the platen 42 and then the position of the paper S is fixed. Then, even though the cleaning mat 80 is provided, the cleaning mat 80 is adsorbed onto the platen 42 by being sucked by the air of the adsorption fan 424 through the adsorption holes 422 of the platen plate 421 and then the position of the cleaning mat 80 may be fixed. In addition, the invention is not limited to the embodiment. For example, in a case of the printer 1 in which the paper S is electrostatically attracted onto the platen 42, the cleaning mat 80 is electrostatically attracted and may be fixed to on the platen 42. By doing this, the adhesive members 87*a* and 87*b* are not necessary to provide on the rear surface of the substrate 81 of the cleaning mat 80, the method of manufacturing of the cleaning mat 80 can be simplified and the reduction of the cost can be achieved.

In addition, as illustrated in FIG. 3, in the printer 1 of the embodiment, the head 41 protrudes from the lower surface of the carriage 31, however, the invention is not limited to the embodiment. For example, there is also a printer 1 in which the lower surfaces of the carriage 31 and the head 41 may be flat without a step between the lower surface (in other words, a surface facing the platen 42) of the carriage 31 and the lower surface of the head 41. In this case, the cleaning mat 80 may come into contact with the lower surfaces of the head 41 and the carriage 31, and the side surface of the carriage 31. In this case, the head 41 and the carriage 31 correspond to the liquid ejecting section.

Figure 8A:
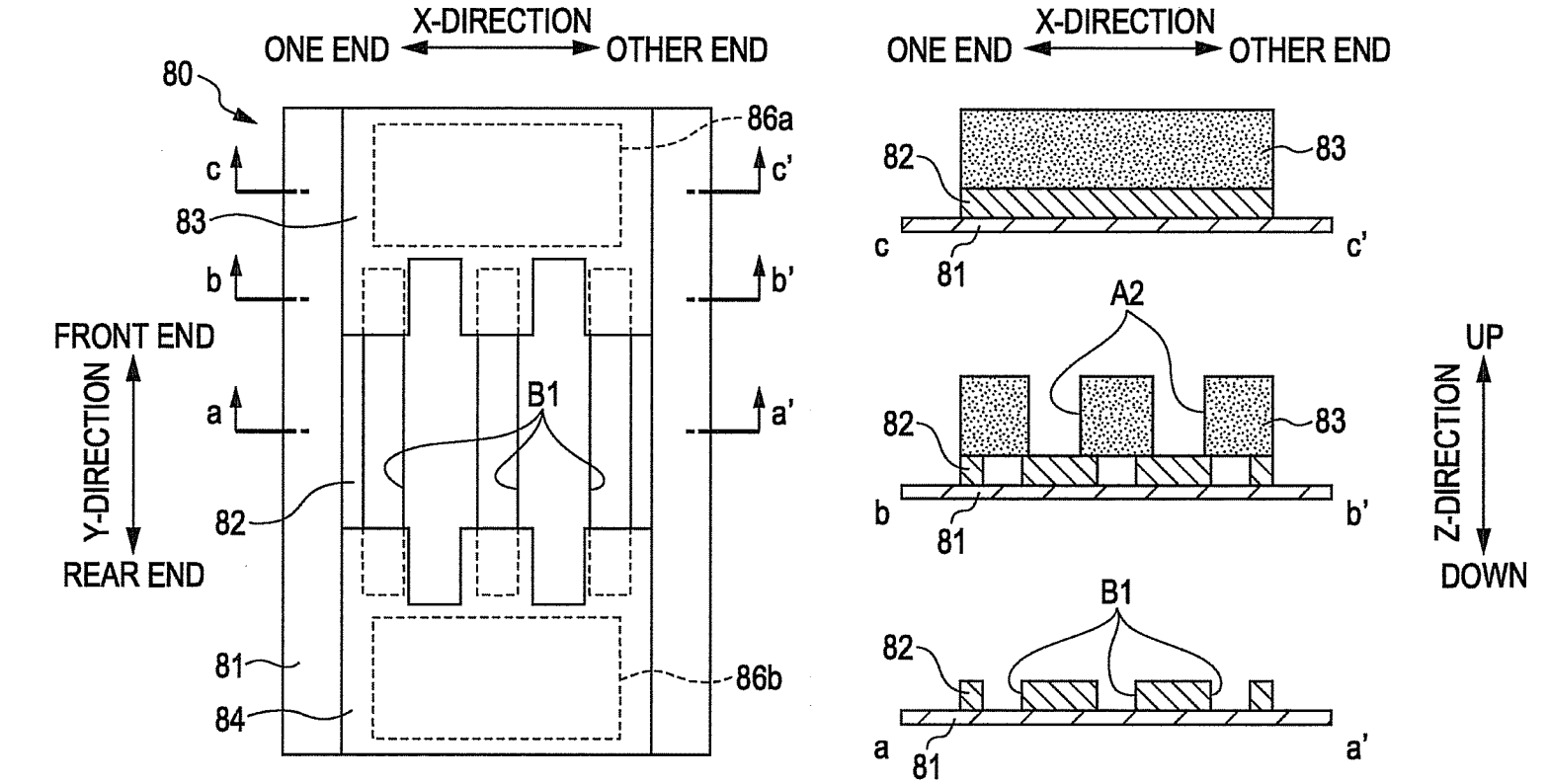
FIGS. 8A and 8B are views illustrating other modification examples of the cleaning mat.
Figure 8B:
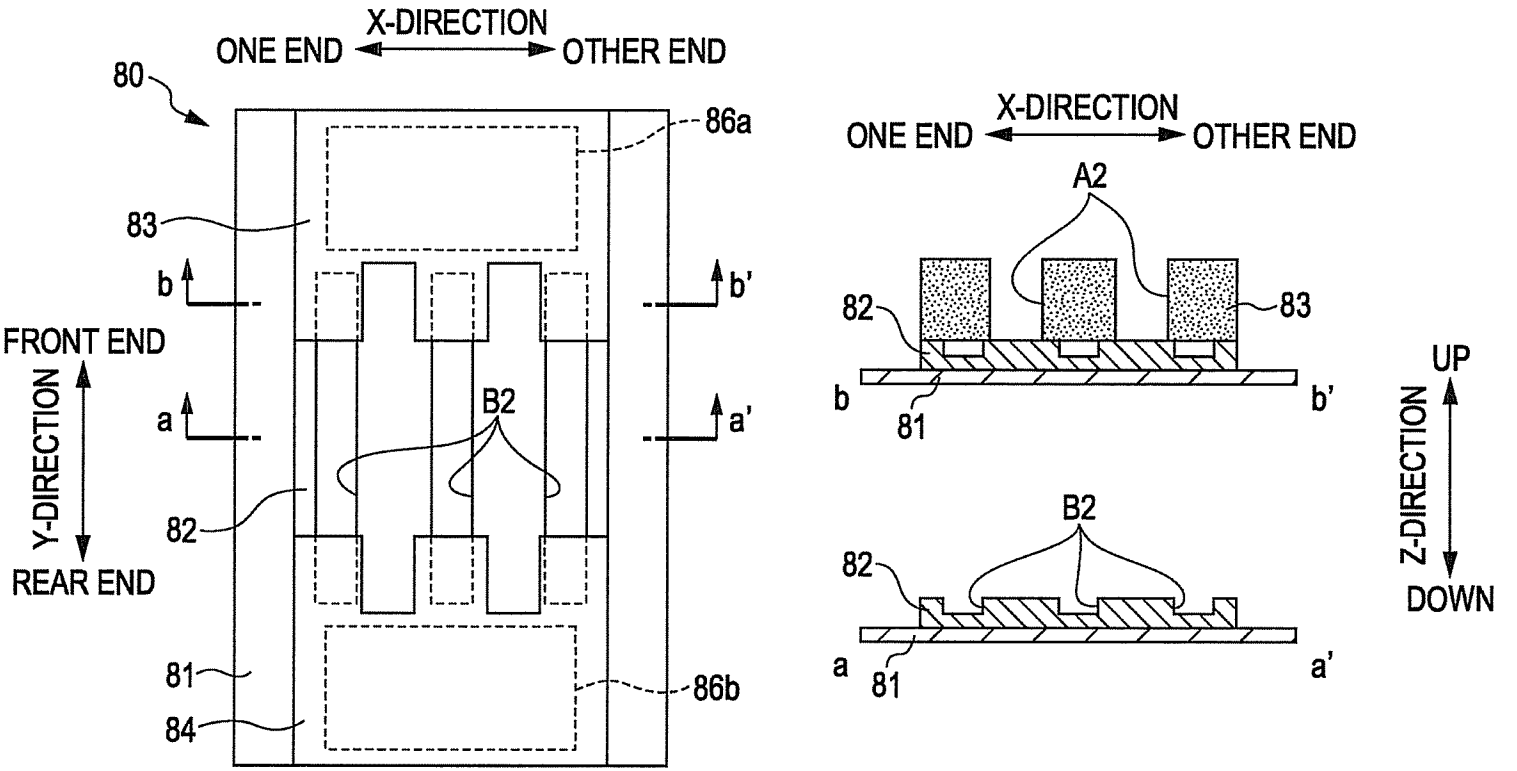

FIGS. 8A and 8B are views illustrating other modification examples of the cleaning mat 80. The left side in each of views illustrates a top view of the cleaning mat 80 and the right side illustrate a cross-sectional views of the cleaning mat 80 which are taken along a position aa', a position bb' and a position cc' of the top view. So far, that the upper surface of the bottom section 82 of the cleaning mat 80 is flat is exemplified, however, the invention is not limited to the embodiments. As illustrated in FIGS. 8A and 8B, the cleaning mat 80 may be included in which recesses B1 and B2 which are recessed into the substrate 81 than the surrounding thereof are provided on the upper surface of the bottom section 82.

As illustrated in the cross-sectional view of the position aa', the bottom section 82 of the cleaning mat 80 in FIG. 8A has the recess section B1 which penetrates from the upper surface of the bottom section 82 to the lower surface thereof and the substrate 81 is exposed from the recess section B1. The shape of the upper surface of the recess section B1 is a rectangular shape extending in the Y direction (the transportation direction of the paper S). In addition, three recesses section B1 are arranged in a line with a predetermined interval in the X direction (the moving direction of the head 41) in the center portion of the bottom section 82 in the Y direction. In addition, the length of the recess section B1 in the Y direction is equal to or greater than the length of the head 41 in the Y direction. When describing more detail, the recess section B1 extends between the first stepped section 83 and the second stepped section 84 in the Y direction, and as illustrated in the cross-sectional view of the position bb', the recess section B1 extends below the portion of the three stepped sections 83 and 84 branched by the groove sections A2. Thus, the front end portion and the rear end portion of the recess section B1 in the Y direction are covered by the stepped sections 83 and 84.

As described above, the recess section B1 is provided on the upper surface (the surface of one side) of the bottom section 82 and the portion coming into contact with the nozzle opening surface of the head 41. Accordingly, the foreign matter removed from the nozzle opening surface is dammed in the recess section B1 when the head 41 moves while the nozzle opening surface comes into contact with the bottom section 82 (the sponge). Thus, the foreign matter removed from the bottom section 82 can be suppressed from being attached again on the nozzle opening surface of the head 41 and the head 41 can be further clean state. In addition, it is possible to prevent the foreign matter removed from the bottom section 82 from falling on the platen 42 and contaminate the platen 42 or the paper S. In addition, the corner portion configured of the upper surface of the bottom section 82 and the side surface of the recess section B1 is formed by providing the recess section B1 on the bottom section 82. Accordingly, the foreign matter can be removed from the nozzle opening surface of the head 41 by the corner portion as much as possible.

In addition, the recess section B1 extends in the Y direction orthogonal to the moving direction of the head 41 the length of the recess section B1 in the Y direction is preferable to greater than or equal to the length of the nozzle opening surface of the head 41 in the Y direction. By doing this, since the entire region of the nozzle opening surface of the head 41 passes through on the recess section B1, the entire region of the nozzle opening surface of the head 41 is able to clean regardless of the position in the Y direction.

In addition, the recess section B1 may be provided on the upper surface of the bottom section 82 and a portion below the three stepped sections 83 and 84 branched by the groove sections A2. By doing this, the length of the recess section B1 in the Y direction can be greater than or equal to the length of the nozzle opening surface of the head 41 in the Y direction. In addition, the foreign matter removed from the side surface of the head 41 by the portion (the movable section) the three branched stepped sections 83 and 84 can be dammed in the recess section B1. Accordingly, the foreign matter removed from the stepped sections 83 and 84 can be suppressed to be attached again on the side surface of the nozzle opening surface of the head 41 and the head 41 can be further clean state. In addition, it is possible to prevent the foreign matter removed from the head 41 from falling on the platen 42.

In addition, the recess section B1 penetrates from the upper surface to the lower surface in the cleaning mat 80 in FIG. 8A, however, the invention is not limited to the embodiment. As the cleaning mat 80 illustrated in FIG. 8B, a recess section B2 may be formed in which a portion of the bottom section 82 is recessed from the upper surface thereof without exposing the substrate 81 from the recess section B2. In addition, the cleaning mat 80 in FIG. 8A is the same as the cleaning mat 80 in FIG. 8B except the position or the shape of the upper surface of the recess section B2 or the depth of the recess section B2. Also in the case, the foreign matter removed from the head 41 can be dammed in the recess section B2 by the bottom section 82 or the stepped sections 83 and 84, and it is possible to prevent the foreign matter from being attached again on the head 41 or from falling on the platen 42.

As described above, if the cleaning mat 80 having the recess sections B1 and B2 is used, the foreign matter is difficult to be attached again on the head 41 and the foreign matter is difficult to fall on the platen 42. Thus, the head 41 can reciprocate with respect to the cleaning mat 80 in the moving direction a plurality of times (for example, 5 times) and the head 41 is able to further clean.

In addition, in the cleaning mat 80 illustrated in FIGS. 8A and 8B, the recess sections B1 and B2 extend to the position below the three branched stepped sections 83 and 84, however, the invention is not limited to the embodiments. For example, the recess section B1 may extend from the first stepped section 83 to the second stepped section 84. In addition, three recess sections B1 and B2 are provided in the cleaning mat 80 in FIGS. 8A and 8B, the invention is not limited to the embodiment. The number of the recess sections B1 and B2 may be other than three. However, since a plurality of the corner sections are configured of the upper surface of the bottom section 82 and the side surfaces of the recess section B1 by providing a plurality of recess sections B1 and B2, the cleaning mat 80 is able to further clean. In addition, the recess sections B1 and B2 may be provided on the cleaning mat 80 having only the bottom section 82 without the cleaning mat 80 or the stepped sections 83 and 84 of the modification examples illustrated in FIGS. 7A to 7E.

Other Embodiments

The above embodiments are intended to facilitate the understanding the invention and it is not intended to be construed as limiting the invention. The invention can be changed and improved, and includes their equivalents without departing from the gist of the invention.

In the above embodiments, the wiper member 51 moves with respect to the head 41 in the transportation direction and the head 41 moves with respect to the cleaning mat 80 in the moving direction, however, the invention is not limited to the embodiments. The head 41 may move with reference to wiper member 51 and the platen 42 in which the cleaning mat 80 is provided may move with respect to the head 41. In addition, the invention is not limited to that a relative moving direction (the transportation direction) of the head 41 and the wiper member 51 and a relative moving direction (the moving direction) of the head 41 and the cleaning mat 80 are different by 90 degrees. Each of the moving directions may be different from the degrees, respectively, and each of the moving directions may be the same as each other.

In the above embodiments, the printer is exemplified in which the operation of ejecting the ink while the head moves in the moving direction and the operation of transporting the paper are repeated alternately, the invention is not limited to the embodiments. For example, the invention may be a printer of a type in which the head ejects the ink toward the paper when the paper passes through in a direction intersecting the width direction thereof blow the head on which the fixed nozzles are arranged in the width direction of the paper. In addition, for example, the invention may be a printer of a type in which the image is printed by performing the operation of printing the image while moving the head in the X direction with respect to the paper transported in the printing region and the operation of moving of the head in the Y direction repeatedly, and, after that, a portion of the paper on which the image is not yet printed is transported in the printing region.

In the above embodiments, as the liquid ejecting apparatus, the ink jet type printer is exemplified, however, the invention is not limited to the embodiments. An apparatus may be applied if the liquid can be ejected from the apparatus and, for example, the same technique of the invention as the embodiments may be applied to various types of apparatuses, in which the ink jet technique is applied, such as a color filter manufacturing apparatus, a dying apparatus, a fine processing apparatus, a semiconductor manufacturing apparatus, a surface processing apparatus, a three-dimensional modeling machine, a gas vaporizer, an organic EL manufacturing apparatus (especially, polymer EL manufacturing apparatus), a display manufacturing apparatus, a film forming apparatus, a DNA chip manufacturing apparatus. In addition, the printer 1 of the above embodiments may be a portion of complex equipment such as a facsimile, a scanner apparatus or a copying apparatus.

The entire disclosure of Japanese Patent Application No. 2012-145563, filed Jun. 28, 2012 and 2012-256414, filed Nov. 22, 2012 are expressly incorporated by reference herein.

What is claimed is:

1. A cleaning member capable of being attached and detached on a liquid ejecting apparatus, comprising:

a substrate;

an elastic member which is provided on one side surface of the substrate and capable of contact with a liquid ejecting section included in the liquid ejecting apparatus, wherein an adhesive member is provided on a surface of the other side of the substrate, and wherein a region in which the adhesive member is not provided is present on an end portion in a direction intersecting a predetermined direction in which the cleaning member and the liquid ejecting section are relatively moved in the surface of the other side of the substrate.

2. The cleaning member according to claim 1, wherein the elastic member has a fixing section of which the position is fixed to the substrate and a movable section which is a portion coming into contact with the liquid ejecting section and is provided so as to be displaceable with respect to the fixing section.

3. The cleaning member according to claim 1, wherein the elastic member has a bottom section which is a fixing section of which the position is fixed to the substrate and comes into contact with a liquid ejecting surface of the liquid ejecting section, and wherein a recess section is provided on a surface of one side of the bottom section and on a portion coming into contact with the liquid ejecting surface of the liquid ejecting section.

4. The cleaning member according to claim 3, wherein the elastic member has a stepped section coming into contact with a side surface of the liquid ejecting section on a surface of the one side of the bottom section, wherein the stepped section has a fixing section of which the position is fixed to the substrate and a movable section which is a portion coming into contact with the side surface of the liquid ejecting section and is provided so as to be displaceable with respect to the fixing section, and wherein a recess section is provided on a surface of one side of the bottom section and on a portion below the movable section.

5. A liquid ejecting apparatus comprising:

an attaching-detaching section in which the cleaning member according to claim 1 is attached and detached;

a liquid ejecting section which moves relative to the cleaning member in a predetermined direction; and a wiper member which moves relative to the liquid ejecting section in a direction intersecting the predetermined direction and removes foreign matter attached to a liquid ejecting surface of the liquid ejecting section.

6. A cleaning member capable of being attached and detached on a liquid ejecting apparatus, comprising:

a substrate;

an elastic member provided on one side surface of the substrate and capable of contact with a liquid ejecting section included in the liquid ejecting apparatus; and an adhesive member that attaches and detaches the cleaning member to the liquid ejecting apparatus.

* * * * *